United States Patent [19]

Dalbo et al.

[11] Patent Number: 4,478,333

[45] Date of Patent: Oct. 23, 1984

[54] NEEDLECRAFT CASE WITH EXTENDER

[75] Inventors: Lorraine E. Dalbo; Emil J. Dalbo, both of Atlanta, Ga.

[73] Assignee: Dal-Craft, Inc., Atlanta, Ga.

[21] Appl. No.: 464,957

[22] Filed: Feb. 8, 1983

[51] Int. Cl.[3] ..... B65D 85/24

[52] U.S. Cl. ..... 206/380; 206/574; 206/575; 150/52 C; 223/109 R

[58] Field of Search ..... 206/380, 574, 575, 223, 206/231, 232, 379, 472, 372, 373; 223/109 R; 150/34, 52 C, 39

[56] References Cited

U.S. PATENT DOCUMENTS

| | | | |
|---|---|---|---|
| 1,171,896 | 2/1916 | Simpson | 206/373 |
| 1,214,282 | 1/1917 | Day | 150/34 |
| 1,266,091 | 5/1918 | Basch | 150/34 |
| 1,434,350 | 10/1922 | Collins | 206/373 |
| 1,679,101 | 7/1928 | Sternthal | 150/52 C |
| 1,895,074 | 1/1933 | Hagerstrom | 150/34 |
| 2,218,892 | 10/1940 | Ratzlaff | 150/52 C |
| 2,628,711 | 2/1953 | Flannery | 150/34 |
| 3,749,233 | 7/1973 | McCormick, Jr. | 150/52 C |
| 4,314,635 | 2/1982 | Fraser et al. | 206/232 |
| 4,391,370 | 7/1983 | Dalbo | 206/223 |

FOREIGN PATENT DOCUMENTS

| | | | |
|---|---|---|---|
| 1263392 | 5/1961 | France | 150/39 |
| 1452854 | 8/1966 | France | 150/39 |

*Primary Examiner*—William T. Dixson, Jr.
*Assistant Examiner*—Brenda J. Ehrhardt
*Attorney, Agent, or Firm*—James B. Middleton

[57] ABSTRACT

A storage case for needlecraft materials and the like, with an extender for the case. The storage case has three sections hinged together so the case can be folded into thirds, each of the three sections having pockets for storing materials for easy retrieval. At least one section has a sub-divided pocket for receiving knitting needles. A flap above the sub-divided pocket can either cover the ends of short needles, or lie against the backing to allow long needles to pass over the flap. Another flap is positioned to cover the ends of the long needles. One end section has a large pocket opening towards the hinge. An extender is foldable about its hinge into two sections. One section of the extender can be placed into the large pocket, and the entire case can be closed as one case.

8 Claims, 8 Drawing Figures

NEEDLECRAFT CASE WITH EXTENDER

FIELD OF THE INVENTION

This invention relates generally to carrying cases, and is more particularly concerned with a highly versatile storage and carrying case for needlecraft materials with means for extending the capacity of the carrying case.

BACKGROUND OF THE INVENTION

There are numerous storage cases and carrying cases for the materials necessary for needlecrafts and many other crafts. While prior art cases have met with some success, such prior art cases are generally limited to a small quantity of material. The usual alternative in the prior art is to provide a relatively large basket or the like to contain a great quantity of material. While a large basket will of course receive a great quantity of material, the particular implements that might be desired at any given time are difficult to locate within such a basket.

The most common use of baskets in the prior art needlecraft cases has been for knitting materials. It will be understood that the full complement of materials for knitting comprises a very large quantity of knitting needles of various lengths, in addition to numerous smaller accessories. Also, the usual booklets, instructions and the like need to be included. As a result, it has been found extremely difficult to organize the materials to be carried, yet to allow sufficient versatility for the individual to store, in an organized fashion, the particular items desired. Thus, the most commonly used storage cases for knitting materials are the relatively large baskets, or simply a shopping bag or the like.

SUMMARY OF THE INVENTION

The present invention overcomes the above mentioned and other difficulties with the prior art by providing a foldable storage case having a plurality of pockets for receiving various items to be stored. At least one of the foldable sections of the case includes a pair of selectively usable flaps for allowing at least one pocket to be used for long and/or short needles or other elongate objects. Additional foldable sections include pockets for storing other accessories. The present invention further includes a selectively usable extender having a plurality of foldable sections, one section of the extender being receivable within a pocket of the carrying case so the carrying case and the extender can be used as a unit, thereby expanding the capacity of the carrying case.

BRIEF DESCRIPTION OF THE DRAWINGS

These and other features and advantages of the present invention will become apparent from consideration of the following specification when taken in conjunction with the accompanying drawings in which.

DESCRIPTION OF AN EMBODIMENT OF THE INVENTION

Figure 1:
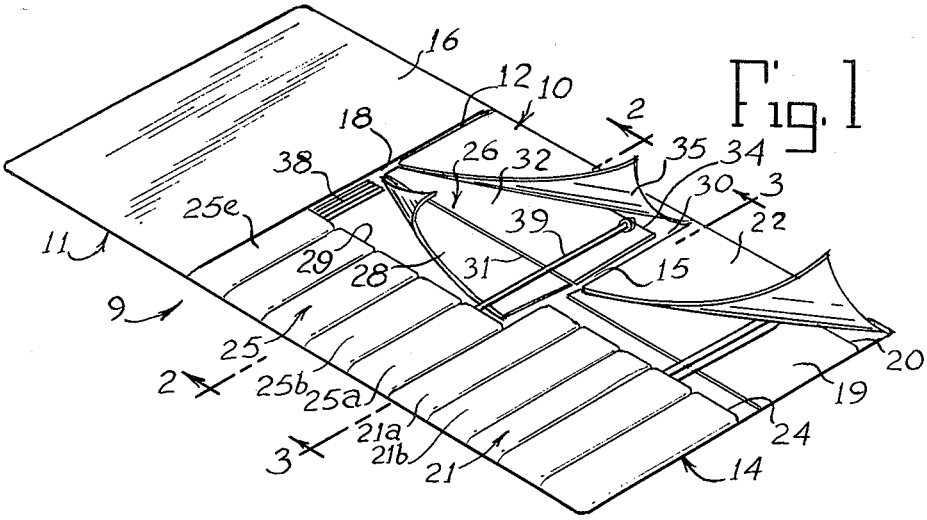
FIG. 1 is a perspective view showing a storage case made in accordance with the present invention, the storage case being fully open and laid flat.

Referring now more particularly to the drawings, and to that embodiment of the invention here presented by way of illustration, FIG. 1 shows a storage case 9 made in accordance with the present invention, the storage case 9 including a center section generally designated at 10, the center section 10 having one end section 11 hinged thereto along a hinge line 12. At the opposite side of the center section 10, there is an end section 14 hinged to the center section 10 along a hinge line 15. Thus, as will be discussed in more detail hereinafter, the storage case 9 shown in FIG. 1 of the drawings can be folded substantially in thirds by folding one of the end sections 11 and 14 over the center section 10, then folding the other end section over the first end section.

It will be understood that, in the following description, specific pockets are described as being in specific locations, and the order of folding becomes important due to the location of the pockets. However, those skilled in the art will understand that the storage case 9 may be rearranged as to the locations of the pockets, and the particular description is by way of illustration, and is not intended to be limiting.

In FIG. 1, the end section 11 includes a pocket 16 having an opening designated at 18. The end section 11 comprises one pocket which is admirably adapted to receive relatively large, flat objects such as booklets, instruction sheets, a magnet board or the like.

The right-hand end section designated at 14 includes an upper storage pocket 19 having an opening at 20. The pocket 19 extends substantially the full width of the end section 14, and it will be understood that the pocket 19 can receive numerous small items.

In the lower portion of the end section 14, it will be seen that there is a pocket generally designated at 21, the pocket 21 being sub-divided into a plurality of smaller pocket portions such as the pocket portions 21*a*, 21*b* etc. As is indicated in FIG. 1 of the drawings, it is contemplated that the pocket 21 will receive elongate items such as knitting needles. The various sub-pockets 21*a*, 21*b* etc. can have various widths to receive large diameter needles, small diameter needles and the like.

Fixed generally along the uppermost edge of the end section 14, there is a flap 22, the flap 22 extending down into the end section 14, and terminating somewhat short of the upper edge 24 of the pocket 21.

Figure 3:
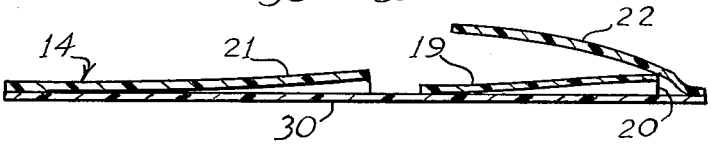
FIG. 3 is a cross-sectional view taken substantially along the line 3—3 in FIG. 1.

With some attention to FIG. 3 of the drawings, it will be seen that knitting needles or other elongate items can be received within the pocket 21 while various small items can be received within the pocket 19. The flap 22 extends down to close the opening 20 in the pocket 19, and continues to extend down far enough to cover the upper ends of needles and the like that may be received within the pocket 21. The end section 14 therefore provides a secure storage space for an assortment of small objects as well as for a number of knitting needles or other lengthy items.

Figure 2:
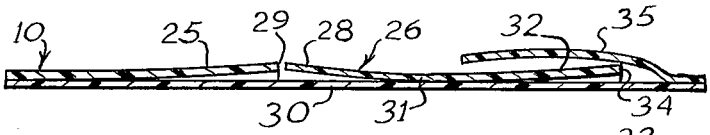
FIG. 2 is a cross-sectional view taken substantially along line 2—2 in FIG. 1.

Looking now at the center section 10, with attention to FIG. 2 of the drawings, it will be seen that there is a lower pocket 25, the pocket 25 being subdivided into a plurality of sub-pockets 25*a*, 25*b* etc. Substantially immediately above the pocket 25, it will be seen that there is a piece of material generally designated at 26 and forming a flap 28 extending from immediately above the opening 29 of the pocket 25, the material 26 being fixed to the backing sheet 30 as at 31. From the seam 31, the material 26 extends upwardly to form a pocket 32, the edges of the pocket 32 being fixed to the backing sheet 30 as is indicated in FIG. 1 of the drawings. The material 26 terminates in an upwardly opening pocket 32, the opening 34 being somewhat below the uppermost edge of the backing sheet 30. There is then a flap 35 fixed to the uppermost edge of the backing sheet 30, and extending downwardly to act as a flap for the pocket 32.

With especial attention to FIG. 1 of the drawings, it will now be understood that the pocket 25 can be used for a great variety of long objects such as knitting needles, crochet hooks and the like. In FIG. 2 of the drawings, it will be seen that the flap 28 can lie flat against the backing sheet 30, or can be moved out from the backing sheet 30. As is shown in FIG. 1, this structure allows shorter items as indicated at 38 to be received in the sub-pocket 25*e*, the short items 38 extending beneath the flap 28 and terminating before the seam 31. Obviously, short items such as the items 38 could completely fill the pocket 28 if desired.

Alternatively, it will be seen that there is a long knitting needle 39 received in the sub-pocket 25*a*. When long items are to be stored in the pocket 25, it will be seen that the flap 28 is placed against the backing sheet 30 so the flap 28 does not interfere with the item 39. In this instance, it will be seen that the item 39 extends upwardly, over the flap 28 and the pocket 32, to terminate beneath the flap 35. This latter use provides an arrangement similar to that described in conjunction with the end section 14 wherein the flap 35 covers both the pocket 32 and the ends of the needles or the like 39.

Figure 4:
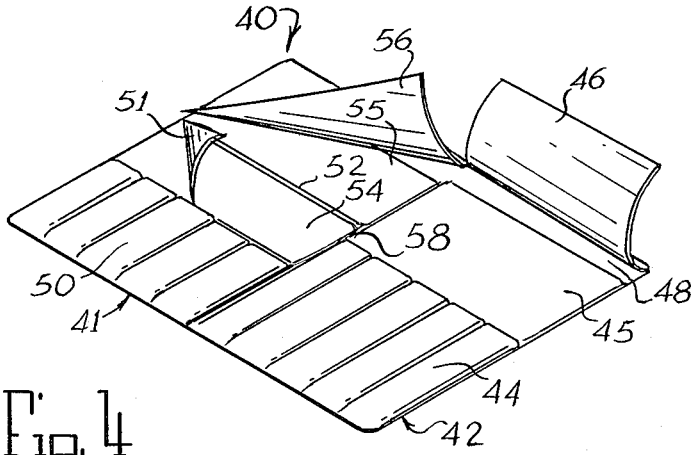
FIG. 4 is a perspective view similar to FIG. 1, but showing the extender for the carrying case.

Attention is next directed to FIG. 4 of the drawings which shows the extender generally designated at 40. The extender 40 includes two sections designated at 41 and 42. Without detailed repetition, it will be seen that the section 42 includes a pocket 44 that is sub-divided for receiving knitting needles and the like. Above pocket 44 is a pocket 45; and, a flap 46 is fixed to the backing sheet 48 for closing the pocket 45 and covering extending ends of knitting needles that are received in the pockets 44. It will be realized that this arrangement is virtually the same as the construction of the end section 14 for the storage case 9.

Similarly, the section 41 of the extender 40 is constructed very similarly to the center section 10 of the storage case 9 shown in FIG. 1. There is a pocket 50 subdivided to receive knitting needles and the like, and a piece of material 51 is fixed to the backing sheet at 52 to provide a flap 54 and a pocket 55. An additional flap 56 is fixed to the upper end of the backing sheet 48 for closing the pocket 55, and covering the upper ends of needles that extend over flap 54 and up to the pocket 55.

It will therefore be seen that the extender 40 is a virtual duplication of two of the sections of the carrying case 9 shown in FIG. 1 of the drawings. While other pocket arrangements may be used, the particular arrangement has been found to be highly desirable so that, when an extender is desired, this particular pocket arrangement will generally be found to be very useful.

Figure 5:
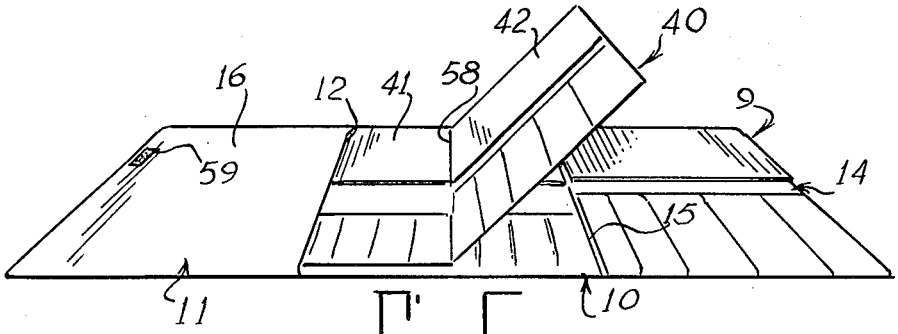
FIG. 5 is a perspective view showing the extender of FIG. 4 being inserted into a pocket of the storage case shown in FIG. 1.

Attention is next directed to FIG. 5 of the drawings which shows the storage case 9 lying flat, and the extender 40 being inserted into the pocket 16 of the carrying case 9. Before discussing this further, it should be pointed out that the carrying case 9 can be used as a completely separate storage and carrying case, and the case 9 will store a considerable quantity of materials and accessories. Also, the extender 40, though here designated as an extender, is also readily usable as a completely independent carrying case. Though the storage capacity is considerably less than that of the storage case 9, one may frequently wish to use only the extender 40 when relatively few materials are required.

Figure 6:
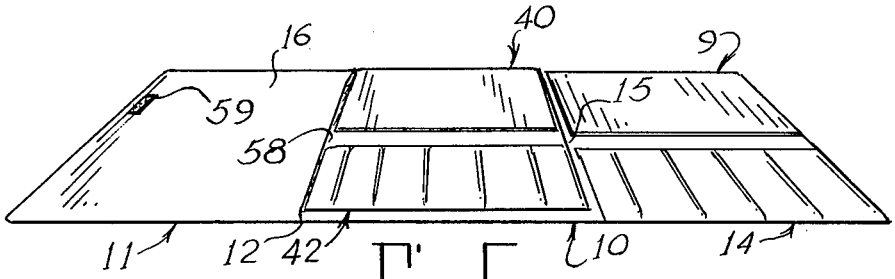
FIG. 6 is a view similar to FIG. 5, but showing the extender fully inserted and lying generally flat on the storage case.
Figure 7:
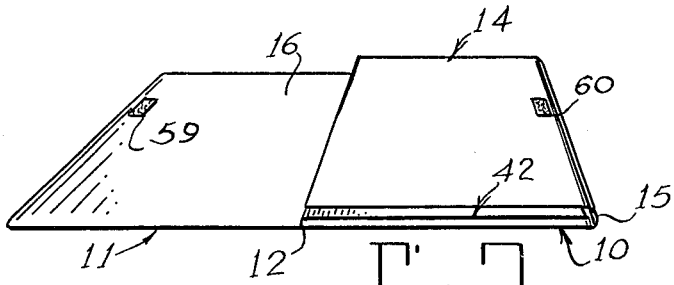
FIG. 7 is a view similar to FIG. 6 showing one end of the carrying case folded; and, FIG. 8 is a view similar to FIG. 7, showing the storage case fully folded.
Figure 8:
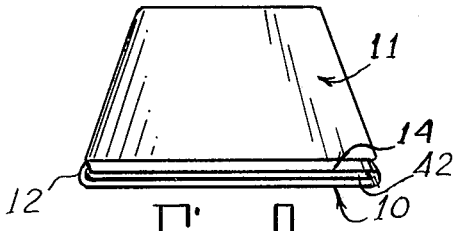

Returning now to FIG. 5 of the drawings, it will be seen that the extender 40 has the center hinge 58, and the section 41 of the extender 40 is receivable within pocket 16 of the storage case 9. The extender 40 is so sized as to be received within the storage case 9 as shown in FIG. 6 of the drawings, the hinge 58 of the extender being located approximately at the hinge 12 of the storage case 9. The section 41 of the extender 40 is completely received within the pocket 16, while the section 42 of the extender 40 rests within the confines of the center section 10 of the storage case 9. As the device is illustrated in FIG. 6, it will be seen that many of the materials are readily available, the section 42 of the extender 40 being liftable to reveal the material stored on the center section 10 of the storage case 9, and other materials being readily available simply by lifting the appropriate flaps. When the case is to be folded, the end section 14 of the storage case 9 will preferably be folded about the hinge line 15 as is shown in FIG. 7 of the drawings. Finally, the end section 11 will be folded over the end section 14 to completely close the case as is shown in FIG. 8 of the drawings.

It will be noticed in FIG. 7 of the drawings that fastening means indicated at 59 and 60 are included. While some form of fastening means may be sometimes desirable, it will be understood that, when the size of the various sections is large enough, there is little tendency for the storage case 9 to open, and the fastening means 59 and 60 may not be necessary or desirable.

It will therefore be seen from the foregoing description that the present invention provides a storage and carrying case 9 admirably adapted to receive a great variety of materials that may be required for needlecrafts. The pocket 16 allows large flat objects to be stored, and the pockets 32 and 19 provide storage space for small items that can be readily retrieved. If desired, of course, the pockets 19 and/or 32 may be made of transparent plastic or the like so the contents can be viewed without feeling into the pocket, or emptying the contents thereof. With the sections 10 and 14 arranged to store knitting needles, crochet hooks and the like, a tremendous variety of such objects can be stored and readily retrieved.

Furthermore, if yet more capacity is needed, the extender 40 can be slipped into the storage case 9 to be used almost as an integral part of the storage case 9. The extender 40 will very readily slip into and out of the pocket 16, so all materials are readily available and accessible when using the extender 40; also, the extender 40 can be readily separated from the storage case 9 so the extender 40 can be used alone if a small quantity of material is needed, and the storage case 9 can be used alone in the event that a somewhat greater quantity of material is needed.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

We claim:

1. A storage case, for needlecraft materials and the like, said storage case comprising a backing sheet, a first hinge in said backing sheet for defining a first end section selectively foldable along said first hinge, a second hinge in said backing sheet for defining a second end section selectively foldable along said second hinge, said first hinge and said second hinge being parallel to each other and spaced apart so that a center section is defined between said first hinge and said second hinge, said first end section, said second end section and said center section being of generally equal width, a plurality of pockets carried by said backing sheet so that all pockets of said plurality of pockets are enclosed when said first end section and said second end section are folded over said center section one pocket of said plurality of pockets being located at the lower edge of said backing sheet and having an upper edge above said lower edge of said backing sheet, a first flap fixed to said backing sheet above said one pocket and extending towards and terminating adjacent to said upper edge of said one pocket so that an elongate object can be received within said one pocket and extend therefrom to be covered by said first flap, a second flap fixed to said backing sheet adjacent to the upper edge of said backing sheet above said first flap and aligned with said first flap and terminating above said first flap so that an elongate object can be received within said one pocket and extend over and beyond said first flap and be covered by said second flap.

2. A storage case as claimed in claim 1, and further including a second pocket of said plurality of pockets carried by said backing sheet above said first flap, said second pocket defining an opening normally closed by said second flap.

3. A storage case as claimed in claim 2, and further including a third pocket carried by said first end section, said third pocket being generally coextensive with said first end section and defining an opening adjacent to said first hinge, and a case extender, said case extender comprising a first extender section and a second extender section, a first plurality of extender pockets carried by said first extender section, and a second plurality of extender pockets carried by said second extender section, an extender hinge connecting said first extender section and said second extender section, said first extender section with said first plurality of extender pockets being selectively receivable within said third pocket with said extender hinge generally overlying said first hinge, the arrangement being such that said first section and said section are foldable over said center section with said first extender section received within said third pocket and said second extender section generally overlying said center section.

4. A storage case for needlecraft materials and the like, said storage case comprising a backing sheet, a first hinge in said backing sheet for defining a first end section selectively foldable along said first hinge, a second hinge in said backing sheet for defining a second end section selectively foldable along said second hinge, said first hinge and said second hinge being parallel to each other and spaced apart so that a center section is defined between said first hinge and said second hinge, said first end section, said second end section and said center section being of generally equal width, a plurality of pockets carried by said backing sheet so that all pockets of said plurality of pockets are enclosed when said first end section and said second end section are folded over said center section, a first pocket of said plurality of pockets carried by said first end section, said first pocket being generally coextensive with said first end section and defining an opening adjacent to said first hinge, and a case extender, said case extender comprising a first extender section and a second extender section, a first plurality of extender pockets carried by said first extender section and a second plurality of extender pockets carried by said second extender section, an extender hinge connecting said first extender section and said second extender section, said first extender section with said first plurality of extender pockets being selectively receivable within said first pocket with said extender hinge generally overlying said first hinge, the arrangement being such that said first end section and said second end section are foldable over said center section with said first extender section received within said first pocket and said second extender section generally overlying said center section.

5. A storage case as claimed in claim 4, a second pocket of said plurality of pockets being located at the lower edge of said center section and having an upper edge above said lower edge of said center section, a first flap fixed to said center section above said second pocket and extending towards and terminating adjacent to said upper edge of said second pocket so that an elongate object can be received within said second pocket and extend therefrom to be covered by said first flap, a second flap fixed to said center section adjacent to the upper edge of said center section above said first flap and aligned with said first flap and terminating above said first flap so that an elongate object can be received within said second pocket and extend over and beyond said first flap and be covered by said second flap.

6. A storage case as claimed in claim 5, and further including a third pocket of said plurality of pockets carried by said center section above said first flap, said third pocket defining an opening normally closed by said second flap.

7. A storage case as claimed in claim 6, said second pocket being divided into a plurality of sub-pockets for receiving elongate objects.

8. A storage case as claimed in claim 4, a first extender pocket of said plurality of extender pockets carried by said first extender section at the lower edge thereof, said first extender pocket having an upper edge above said lower edge of said first extender section, a first extender flap fixed to said first extender section above said first extender pocket and extending towards and terminating adjacent to said upper edge of said first extender pocket so that an elongate object can be received within said first extender pocket and extend therefrom to be covered by said first extender flap, a second extender flap fixed to said first extender section adjacent to the upper edge of said first extender section above said first extender flap and aligned with said first extender flap so that an elongate object can be received within said first extender pocket and extend over and beyond said first extender flap and be covered by said second extender flap.

* * * * *